United States Patent [19]

Shearer

[11] 3,945,048

[45] Mar. 23, 1976

[54] DISPOSABLE BIB AND METHOD FOR MAKING THE SAME

[76] Inventor: Janet Shearer, 10634 Atlanta Ave., Northridge, Calif. 91324

[22] Filed: Mar. 25, 1975

[21] Appl. No.: 561,947

[52] U.S. Cl. ..... 2/49 R
[51] Int. Cl.[2] ..... A41B 13/10
[58] Field of Search ..... 2/49 R, 49 A

[56] References Cited

UNITED STATES PATENTS

| | | | |
|---|---|---|---|
| 2,763,867 | 9/1956 | Chagnon | 02/49 R |
| 3,032,773 | 5/1962 | Piazze | 2/49 R |
| 3,416,157 | 12/1968 | Maroler et al. | 2/49 R |
| 3,851,336 | 12/1974 | Hjerl | 2/49 R |
| 3,857,116 | 12/1974 | Meeker | 2/49 R X |

*Primary Examiner*—Alfred R. Guest
*Attorney, Agent, or Firm*—Huebner & Worrel

[57] ABSTRACT

A one piece bib having slits for providing a head opening and having a pocket for catching spilled food and the like is made from a single sheet. The lower longitudinal edges of a generally oblong sheet are cut away on the bias; the sheet is folded on the longitudinal center line and the lower edges are sealed together. When the sheet is unfolded, a V-shaped pocket has been formed to stand open to receive any food that has been spilled by the wearer.

In the method of making the bib slits may be cut in an elongated sheet adjacent its upper edge to define a head opening. In the same operation, longitudinal edge portions or corners at the lower end are cut off on a bias, and folds are formed at the longitudinal center line and from the longitudinal center line to opposite edges of the bib at the upper severing points where the material is cut away. The sheet is then folded along the center line and the lower edges are sealed. When the bib is unfolded a V-shaped pocket has been formed.

15 Claims, 9 Drawing Figures

DISPOSABLE BIB AND METHOD FOR MAKING THE SAME

BACKGROUND OF THE INVENTION

The invention relates to disposable bibs having a head opening adjacent the upper end and a pocket at the lower end. In the prior art there have been bibs with pockets and head openings, but they have been relatively complicated and as a result relatively expensive, particularly where attempts have been made to provide a pocket that will stand open. In the present invention, a pocket that continually stands open during use has been provided in a very simple manner. The bib can be manufactured at a low cost because of its simplicity, and can be made for repeated use.

SUMMARY OF THE INVENTION

According to the invention, a disposable bib is provided that is easy to put on anyone through the head opening, and which has a continuously open pocket at the lower end.

It is an object of the invention to provide an improved disposable bib which eliminates washing of bibs, cleaning of the wearer's clothing underneath the bib, and cleaning of the surrounding area. The bib is adapted for use in the home, travel, in hospitals, on picnics and in restaurants.

The bib may be typically made of absorbent paper backed with sealing, polyethelene sheet material. The paper absorbs any liquid and the polyethelene prevents the wearer from becoming wet, and also strengthens a very thin bib so that it will hold the weight of liquids or other materials which may be received into the pocket. Because the bibs may be made extremely thin, they are easily packaged in rolls.

In addition to the primary utilitarian function, the bibs may employ designs, including educational subject matter, from which a young child may learn, each bib having different information thereon.

The structure of the present invention is such that it may be easily put on anyone, and tucked into the wearer's collar. It is particularly beneficial for use by very young children and by handicapped children, and in hospitals and convalescent homes.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes.

DESCRIPTION OF THE PREFERRED EMBODIMENTS

Figure 1:
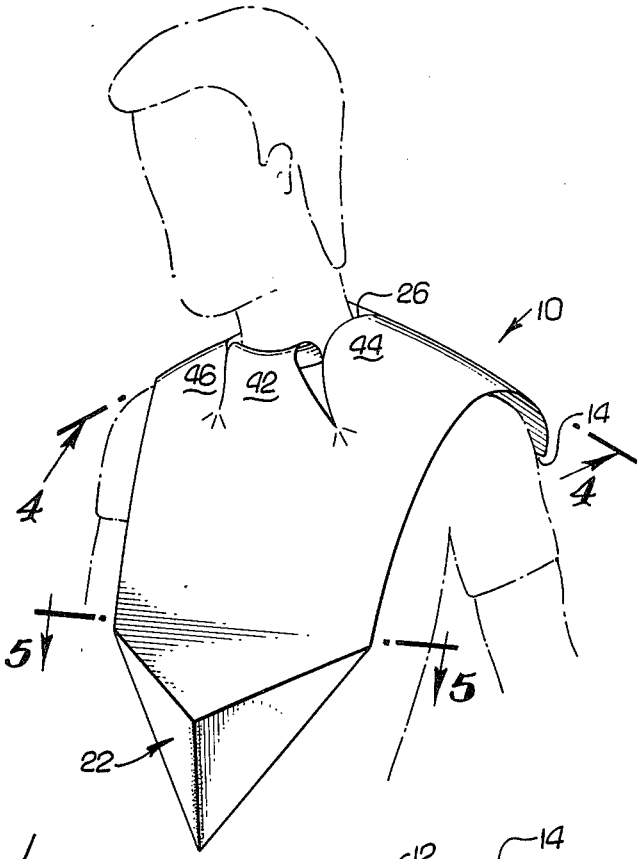
FIG. 1 is a front elevational view of the bib according to the invention, shown in position for use on a wearer.
Figure 2:
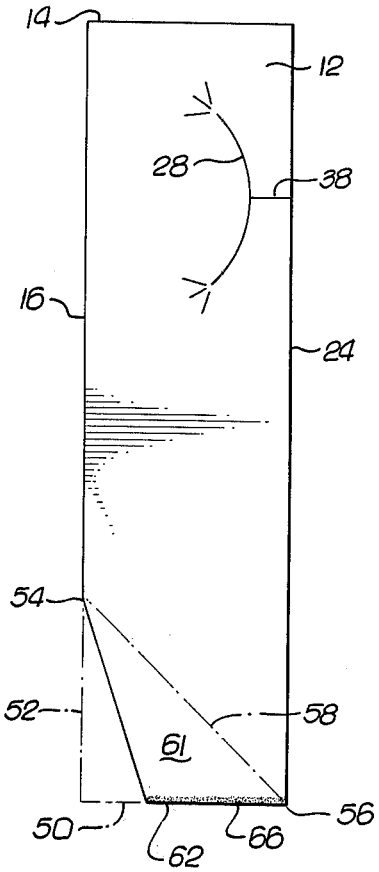
FIG. 2 is a side elevational view of the bib folded along the longitudinal center line and enclosing the front face thereof.

Referring again to the drawings, there is shown in FIG. 1 a bib, generally designated as 10, being worn for use. As shown in FIG. 2, because of the thinness of the material from which the bibs may be made, they may be distributed in rolls of the bibs folded as shown. Such bibs can be made, for example, from polyethelene material alone, or soft absorbent paper backed by polyethelene.

Figure 3:
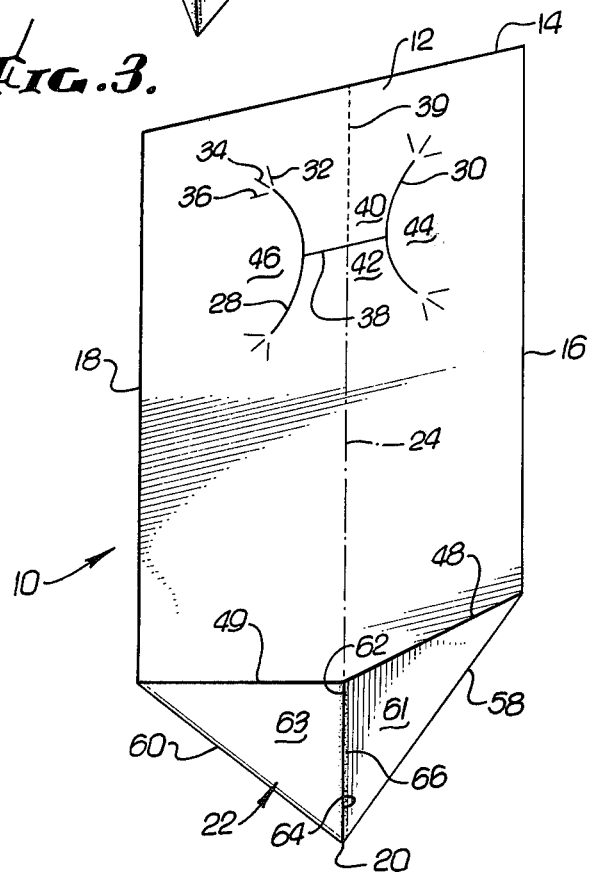
FIG. 3 is a perspective front view of the bib.
Figure 4:
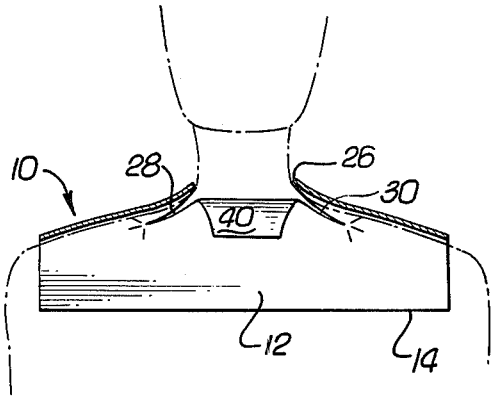
FIG. 4 is a fragmentary cross-sectional view, taken substantially along the lines 4—4 in FIG. 1.

In FIG. 3 the bib is shown open in the form made from a generally oblong sheet having an upper end 12 and an upper lateral edge 14, parallel longitudinal side edges 16 and 18, and a lower end 20 on which there is a V-shaped pocket, generally designated as 22. A central longitudinal fold is shown in a broken line 24, the bib in FIG. 2 being folded on the line, enclosing the front. As best seen in FIG. 3 there are shown a plurality of slits which are cut into the upper end to provide a head opening 26, as shown in FIGS. 1 and 4. Two of the slits 28 and 30 are in the form of spaced arcs, approximately equal to one-quarter of a circle or less, having their convex edges facing each other. At the ends of the arcs are three short slits 32, 34 and 36 provided to increase the size of the head opening as needed and to tend to eliminate stress against tearing in any one direction. Extending between the arced slits is a straight line slit 38 in substantial alignment with the centers of the arcs. The arrangement of the slits provides two flaps 40 and 42 spaced between the arced slits and having concave edged formed by the arcs. The center fold 24 has perforations 39 extending from the slit 38 to the edge 14. By pulling the perforations open, the bib can be removed without going over the head.

The arced slits provide shoulder fitting areas 44 and 46, the upper edge 14 extending down over the back, as may be seen in FIG. 1. The arced slits provide size variations; that is, if the head opening is the approximate size for the neck the edge of the arcs will fit close thereto, as shown in FIG. 1, but if the neck is larger, the areas 44 and 46 will curl upwardly or can be folded inwardly. The flaps 40 and 42 provide the advantage of being easily tucked into the wearer's clothing, under the collar, to make the bib secure on the wearer. The concave edges on the flaps 40 and 42 make it easier and neater to tuck the flaps under the wearer's collar.

In FIG. 2, where the bib is shown folded, the pocket not being formed, and in FIG. 3, the pocket being formed, bias cuts on both sides of the lower end 20 are shown at 48 and 49. The material cut away removed the lower corners of a rectangular sheet and was in the form of a right triangle, shown in phantom outline in FIG. 2, having a relatively short base 50 in the lateral direction and a relatively long right angle leg 52 in the longitudinal direction. Extending between the upper end 54 at the cutoff and the central fold line 24 at 56 are fold lines 58 and 60, as shown in FIG. 3. At the lower end, the remaining lateral portion areas in the form of triangles 61 and 63 have their lower edges 62 and 64 on both sides of the central fold line secured together by sealing material 66, the triangles having a common side at the seal. The edges 48 and 62 and 49 and 64 form respective obtuse angles of the triangles and the edges at 58 and 16 and 60 and 18 also form obtuse angles.

The sealing material may be a suitable glue applied during manufacture, adhesive tape, or may be in the form of a pressure sensitive adhesive. The seal may also be effected on various plastic materials by means of the application of heat.

Figure 5:
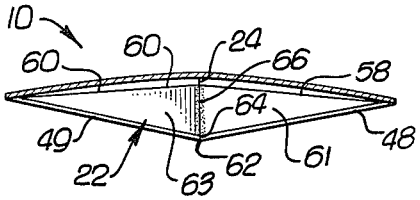
FIG. 5 is a plan view of the open pocket of the bib, taken substantially along the lines 5—5 in FIG. 1.

When the bib is unfolded from the position in FIG. 2, as shown in FIGS. 3 and 5, the pocket 22 is formed and stands open at all times, and particularly when the bib is held vertically because of the structure resulting from bias cuts at 48 and 49. The triangle sides 58 and 60 and 48 and 49 form respective lower and upper V's of the pocket.

Figure 6:
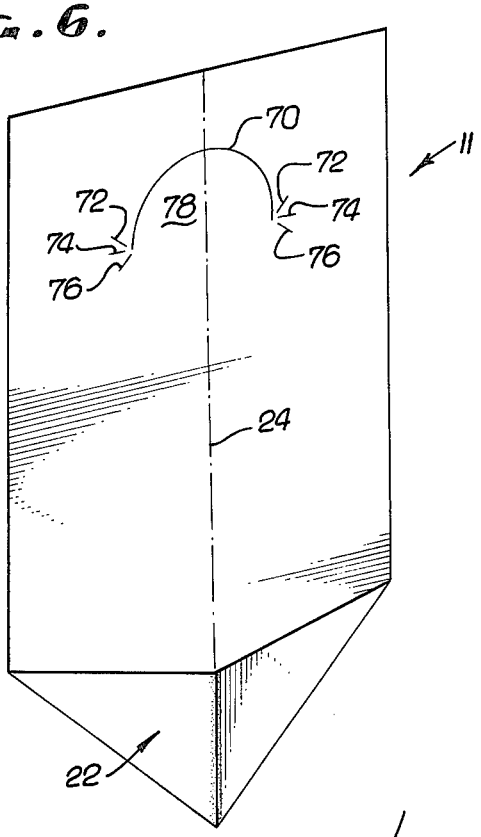
FIG. 6 is a perspective front view illustrating another embodiment of the invention.

In FIG. 6 another embodiment 11 of the invention is shown where the difference is in the head opening formed by means of a semicircular slit 70 having its center on the central fold line 24. At the ends of the slit 70 are three short straight line slits 72, 74 and 76, provided to increase the size of the opening as necessary. With this opening a flap 78 formed within the slit 70 may be tucked into the collar of the wearer, or otherwise under the bib, the semicircular arc fitting against the back of the neck of the wearer or close thereto.

Figure 7:
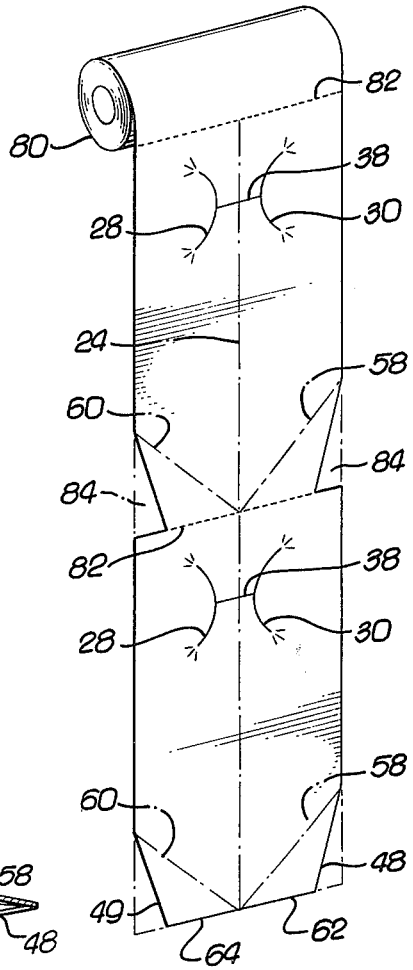
FIG. 7 is a view of a roll of sheet material for use in the process in making the bibs and illustrating the cut and fold lines.
Figure 8:
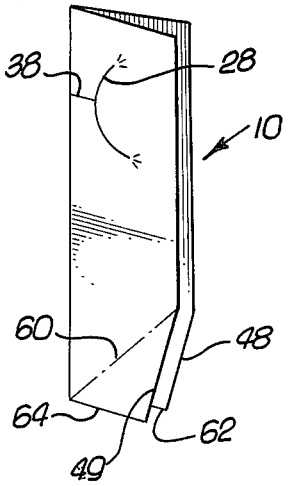
FIG. 8 is a view of a cut and folded bib of sheet material removed from the roll in FIG. 7.
Figure 9:
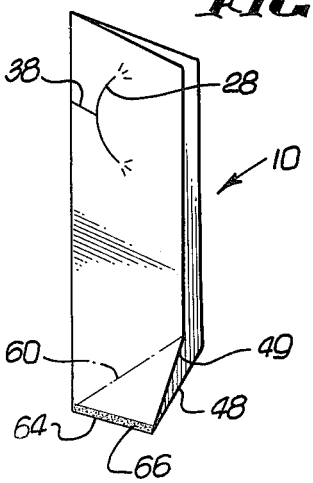
FIG. 9 is a view of the folded bib showing the lower edges sealed together.

In FIGS. 7–9 a method of making the invention is illustrated. In FIG. 7 there is shown a roll of the material 80, such as polyethelene, or a soft absorbent paper backed by polyethelene, for example, from which the bibs may be made. All of the cutting and forming of fold lines can be accomplished in one operation. As the material comes off the roll, at the proper intervals the material is perforated at 82 to provide for easy separation of the individual bibs; all the slits can be cut into the material; and the right triangle areas 84 at the lower ends can be cut off along the bias lines 48 and 49. Similarly, the central fold line 24 and the diagonal fold lines 58 and 60 can be formed by heat or pressure or both.

After the foregoing has been accomplished, the material can be folded on the longitudinal fold line 24, as shown in FIGS. 8 and 9, either before the separation of the individual bibs or after. Before separation, the material from the roll can be continuously moved along on a conveyor and folded after the fold lines have been inserted so as to maintain the bibs in a continuous sheet. As the continuous sheet is moved, it can be sealed at 66, as shown in FIG. 9, by a heat sealing method or by various types of conventional adhesives.

Because of the very thin material, the bibs can be rolled when completed into a single roll of folded bibs, and each one may be pulled off separately along the perforation line 82. Similarly, if desirable, the bibs can be severed and distributed in stacks of folded bibs or stacks of unfolded bibs and sold in tissue type boxes. When the bibs are unpackaged and unfolded, the pocket will automatically open and will be in position to receive material dropped during the eating and drinking of the user.

Another method of making the bibs is to fold the sheet prior to putting it on the roll. As may be visualized from FIG. 2, this permits the use of a die one half the size required in the method illustrated in FIG. 7 and requires only one die to cut off the triangles 84. By having the material prefolded in the roll, it is ready for sealing at 66 when it has been cut.

The invention and its attendant advantages will be understood from the foregoing description and it will be apparent that various changes may be made in the forms, construction and arrangements of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims, wherein various portions have been separated for clarity of reading and not for emphasis.

I claim:

1. In a one piece disposable bib, a sheet having a lateral edge at an upper end of the bib and two longitudinal edges extending downwardly therefrom, a neck opening adjacently spaced from said lateral edge and between said longitudinal edges, the improvement comprising:

a pocket at a lower end of the sheet opposite said upper end, said pocket being open toward said upper end and being V-shaped widthwise along its bottom.

2. The invention according to claim 1 in which:

said V-shaped pocket bottom defines said lower end of said sheet.

3. The invention according to claim 2 in which:

said pocket has a front face formed of two triangles having a common side, said triangles each having a lower side formed by a leg of the V defining the lower end of the sheet.

4. The invention according to claim 3 in which:

said common side of said triangle is defined by two joined sealed edges of said sheet, said sealed edges having been two portions of a lower lateral edge of said sheet, respective area portions of said sheet bounded by each lower lateral edge portion and respective adjacent longitudinal edges having been folded upwardly in the direction from said lower lateral edge and inwardly in the direction from the respective adjacent longitudinal edge to position said sealed edges to form said common side.

5. The invention according to claim 4 in which:

the upper sides of said triangles each form an obtuse angle with said common side.

6. The invention according to claim 5 in which:

before folding each of said lower edge portions comprised half of said lower lateral edge.

7. The invention according to claim 2 in which:

upper edges of said pocket at said opening form a V.

8. The invention according to claim 1 in which:

said head opening is defined by two spaced arced slits and a straight line slit extending therebetween, said straight line slit being in approximate alignment with the centers of said arced slits, said straight line slit extending in the lateral direction.

9. The invention according to claim 8 in which:

said arced slits have a plurality of relatively short slits at their ends.

10. The invention according to claim 8 in which:

a line of perforations extends from said straight line slit to the upper lateral edge.

11. The invention according to claim 1 in which:

said head opening is defined by a semicircular slit having its concave edge generally facing said lower end.

12. A method of making a one piece disposable bib comprising:

cutting slits in a generally elongated sheet adjacent an upper lateral end to define a head opening, cutting longitudinal edge portions from the sheet to remove lower end corners, forming a longitudinally extending central fold line in the sheet, forming fold lines extending from the central fold line at the lower end to the longitudinal edges at the upper severing points of the cutaway longitudinal edge portions, folding said sheet along said center fold line to enclose the front of the sheet, and sealing the lower edges together.

13. A method according to claim 12 including:

cutting said sheets from a roll of sheet material at the same time said other cuts are made.

14. A method according to claim 12 including:

perforating sheet material coming off a roll to define individual elongated sheets at the same time said cuts are made.

15. A method according to claim 12 in which:

said longitudinal edge portions are right triangles having relatively long right angle legs in the longitudinal direction and short bases in the lateral direction.

* * * * *